US006311634B1

(12) United States Patent
Ford et al.

(10) Patent No.: US 6,311,634 B1
(45) Date of Patent: Nov. 6, 2001

(54) SYNCHRONIZING MULTIPLE STEERING INPUTS TO MARINE RUDDER/STEERING ACTUATORS

(75) Inventors: Douglas W. Ford, Newport; Eric K. Juve, Aloha; Douglas F. Paterson, Newport, all of OR (US)

(73) Assignee: Nautamatic Marine Systems, Inc., South Beach, OR (US)

( * ) Notice: Subject to any disclaimer, the term of this patent is extended or adjusted under 35 U.S.C. 154(b) by 0 days.

(21) Appl. No.: 09/474,427

(22) Filed: Dec. 29, 1999

Related U.S. Application Data

(60) Provisional application No. 60/114,361, filed on Dec. 30, 1998.

(51) Int. Cl.[7] ..... B63H 25/00
(52) U.S. Cl. ..... 114/144 R
(58) Field of Search ..... 114/144 R, 144 E, 114/144 A, 144 RE

(56) References Cited

U.S. PATENT DOCUMENTS

| | | | | |
|---|---|---|---|---|
| 4,040,374 | * | 8/1977 | Greene | 114/144 C |
| 4,074,648 | * | 2/1978 | Reid et al. | 114/144 RE |
| 5,107,424 | | 4/1992 | Bird et al. | 364/424.01 |
| 5,253,604 | * | 10/1993 | Bohlin | 114/144 E |
| 5,509,369 | | 4/1996 | Ford et al. | 114/150 |
| 5,632,217 | | 5/1997 | Ford et al. | 114/150 |

* cited by examiner

*Primary Examiner*—Ed Swinehart
(74) *Attorney, Agent, or Firm*—Stoel Rives LLP

(57) ABSTRACT

A steering system (100) includes an incremental helm (102), a control panel (104), and an autopilot (106) that are electrically connected to a command processor (108). The steering system further includes an autopilot attitude controller (110) and an incremental servo (112) for actuating the rudder. The incremental helm acts as a course selector for the autopilot. Upon autopilot engagement, the set heading is the current heading plus any heading change received from the helm after engagement. A course selection controller (120) employs a helm increment summer (122) and a washout filter (124) that are initialized to zero upon engagement. The washout filter follows short-term course changes but forgets them over a longer time. A disengage threshold block (126) receives the washout filter output and disengages the autopilot if the threshold is exceeded. The course selection controller allows a helmsman to make occasional course changes without automatically disengaging the autopilot unless the helmsman rotates the helm at a rate that exceeds the threshold. Upon disengagement, the autopilot is inhibited from re-engaging for a short time, after which the autopilot can re-engage when the turning rate approaches zero. The steering system further includes a helm rotation stop that provides the helmsman with rudder stop position feedback, responds to the rudder stops regardless of the current steering ratio, incorporates a powerful braking action with a low-power mechanism, and provides unidirectional braking at either rudder stop in response to a single steering limit signal.

24 Claims, 9 Drawing Sheets

SYNCHRONIZING MULTIPLE STEERING INPUTS TO MARINE RUDDER/STEERING ACTUATORS

RELATED APPLICATION

This application claims priority from U.S. Provisional Patent Application No. 60/114,361, filed Dec. 30, 1998.

TECHNICAL FIELD

This invention relates to marine autopilots and "fly by wire" steering systems employing incremental rudder commands and a rudder servo that accepts them.

BACKGROUND OF THE INVENTION

Several marine equipment suppliers are now manufacturing "fly by wire" steering and/or engine control systems for marine vessels. Such systems have merit because they simplify the installation and reduce the costs associated with auxiliary control stations. For example, flying bridge and portable remote control stations are simpler to install with wiring than with the plumbing and cabling associated with hydraulic- and cable-actuated control systems.

However, fly by wire systems are not without their problems. Transferring control among multiple helms and an autopilot requires some sort of synchronization of the multiple possible steering commands to each other and to the actual rudder position. (The descriptions presented in this application refer, for purposes of convenience, to a rudder of a marine vessel, although they are also applicable to any marine vessel controllable turning moment generator such as an outboard or outdrive steering angle actuator.) Without synchronization, when control is transferred from one steering input. device to another, the rudder actuator attempts to "jump" to the newly commanded position, creating what is referred to as a control "bump." These problems result from a traditional steering systems paradigm, in which an absolute wheel angle causes a corresponding rudder angle, e.g., a centered (between helm stops) helm rotation angle causes a zero rudder deflection, and a large helm rotation angle (at the helm stop) causes a fully deflected rudder in a corresponding direction.

FIG. 1 represents operational control states found in typical prior art autopilot systems in which a helmsman must steer to a desired heading and press a button to place the autopilot (AP) in an engaged state 10. To place the autopilot in a disengaged or standby state 12, the helmsman must press a standby button, or in some cases, disengage a clutch or turn the helm. Some prior autopilots will revert to engaged state 10 if the helmsman steers back to the original heading. Many prior autopilots further include a power steering feature in which the rudder angle or heading setpoint can be controlled by a handheld remote control or by a knob on the autopilot control panel.

FIG. 2 represents a typical prior art hydraulic steering system in which a helm 22 rotates a helm pump 24, and an autopilot pump motor 26 rotates an autopilot pump 28. Either autopilot pump motor 28 or helm pump 22 can supply fluid to a steering cylinder 30 that actuates a rudder 32. No bump occurs in such a steering system if the autopilot system is engaged when autopilot pump motor 26 is stopped (i.e., starting rudder command equals the current angle of rudder 32). Likewise, no bump occurs when the autopilot is disengaged because rudder 32 simply responds to rotations of helm pump 24. Moreover, if the autopilot is engaged while helm 22 is rotating, the normal response is for the autopilot to correct by causing autopilot pump 28 to subtract fluid from steering cylinder 30 to compensate for fluid added by rotation of helm pump 24. Because of the hydraulically coupled synchronization of such steering systems, there are many known techniques by which helm 22 can automatically override the autopilot. It should be noted that when steering cylinder 30 reaches its stops, helm 22 is also stopped. Of course, steering system 20 may have multiple helms and autopilots hydraulically coupled to steering cylinder 30. With suitable electronic inputs to the autopilot, autopilot pump 28 is usable as a power steering device.

There are previously known non-hydraulic techniques for synchronizing helms and autopilot systems. Referring to FIGS. 3 and 4, U.S. Pat. No. 5,107,424 for CONFIGURABLE MARINE STEERING SYSTEM ("Bird et al.") describes an example of a prior fly by wire steering system 40 having multiple steering devices 42 that are selectable by an input selector 44. To prevent steering angle bumps in steering system 40 when input selector 44 selects a different one of steering devices 42, the newly selected device is first electronically initialized to the current rudder angle. Moreover, mechanical stops associated with steering devices 42 were eliminated so that any newly selected steering device can simply add to or subtract from the rudder position commanded by the previously selected steering device. Accordingly, synchronization among steering devices 42 in steering system 40 employs continuously rotatable, incremental steering devices in combination with steering device initialization.

Bird et al. recognized that incremental steering commands can accumulate to an indefinitely large number. Therefore, each input device limits its output to the maximum deflection of the rudder. FIG. 4 shows that a limiter 50 in controller 46 prevents a rudder actuator 48 from being commanded beyond its mechanical stops. A rudder angle transducer 52 closes the steering servo loop.

Bird et al. implemented helms 54 and 56 with incremental optical encoders driving associated pulse-counting up/down accumulators. However, whenever one of helms 54 or 56 is selected, its up/down accumulator must be reset to zero, making each of helms 54 and 56 yet another initialized device.

What is needed, therefore, is a marine vessel fly by wire steering system that automatically and seamlessly transfers steering control among multiple steering devices, which may include one or more autopilots or helms, without necessarily requiring manual steering device selection.

SUMMARY OF THE INVENTION

An object of this invention is, therefore, to provide a marine steering system for synchronizing inputs from multiple steering devices.

Another object of this invention is to provide a marine steering system having a variable steering ratio that is a function of vessel speed.

A further object of this invention is to provide a marine steering system having a fully automatic autopilot engage/disengage feature that allows a helmsman to set autopilot controlled course changes via the helm.

Still another object of this invention is to provide an apparatus that stops helm rotation when the rudder is at full deflection.

A preferred embodiment of a marine vessel steering system of this invention includes one or more incremental steering devices, a control panel, and an autopilot that are electrically connected to a command processor. The steering system further includes an autopilot attitude controller and an incremental servo for actuating the rudder.

There are many control and interlinking possibilities for the steering system. In one implementation, the autopilot may be engaged or disengaged by pressing buttons alternately on the control panel or on emergency disengaged by rotating an incremental helm a small amount. Course changes may be set in the autopilot by employing a course selection dial or by pressing course change command buttons on the control panel.

In another implementation, an incremental helm is employed as a course selector for the autopilot. A course selection controller is implemented within the command processor and the autopilot attitude controller. Upon engagement of the autopilot, the heading set therein is the current heading at the instant of engagement plus any change of heading received from the helm after engagement. The course selection controller employs a helm increment summer and a washout filter that are both initialized to zero upon engagement. The output of the washout filter follows short-term course changes but forgets them over a longer time. A disengage threshold block receives the output of the washout filter and causes the autopilot to disengage if the output exceeds a predetermined threshold. Accordingly, the course selection controller allows a helmsman to make occasional course changes without the autopilot automatically disengaging, but if the helmsman rotates the helm at a rate and displacement that causes the washout filter output to exceed the predetermined threshold, the autopilot disengages.

The predetermined threshold can be adjusted as a function of vessel speed such that at greater speeds, less wheel rotation is required to disengage the autopilot. Upon automatic disengagement, the autopilot is inhibited from automatic engagement for a short time period by holding the disengagement signal true for about a few seconds. After the short time period expires, the autopilot can automatically engage when the turning yaw rate approaches zero.

The steering system of this invention further includes a helm rotation stop that provides the helmsman with rudder stop position feedback, responds to the rudder stops regardless of the current steering ratio, incorporates a wedging action to provide powerful braking action with a simple, low-power mechanism, and provides unidirectional braking at either rudder stop in response to a single steering limit signal.

Additional objects and advantages of this invention will be apparent from the following detailed description of preferred embodiments thereof that proceed with reference to the accompanying drawings.

DETAILED DESCRIPTION OF PREFERRED EMBODIMENTS

Figure 2:
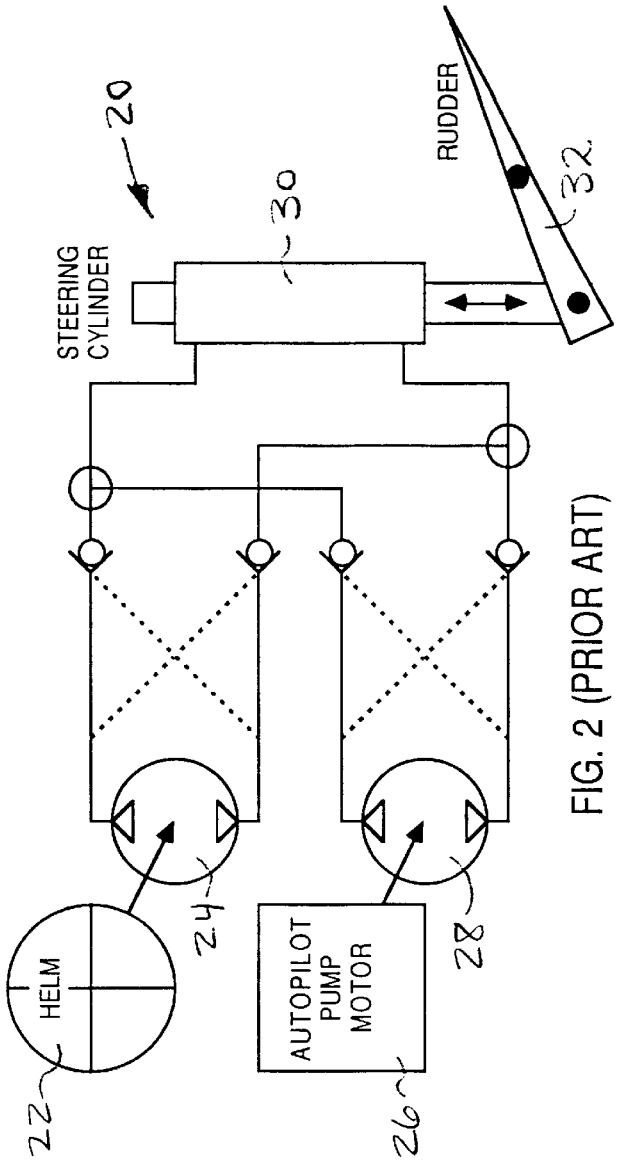
FIG. 2 (PRIOR ART)
FIG. 2 is a simplified block diagram representing a prior art hydraulically actuated helm and autopilot rudder control system.

An understanding of helm and autopilot interrelationships may be gained by analyzing the differential equation representing rudder motion for steering system 20 of FIG. 2. The rudder angle rate of change dr/dt is represented below by Equation 1:

$$dr/dt=(q_{HELM}+q_{AP})/A, \quad (1)$$

where $q_{HELM}=d_{WHEEL}/dt*H_{DISP}$=fluid flow rate from helm pump, $q_{AP}=d_{SHAFTANGLE}/dt*AP_{DISP}$=fluid flow rate from autopilot pump, $d_{WHEEL}/dt$=rate of change of helm wheel angle, $H_{DISP}$=helm pump displacement, $AP_{DISP}$=autopilot pump displacement, and A=steering cylinder 30 area.

Equation 1 shows why steering cylinder 30 can be said to "sum" the inputs from helm pump 24 and autopilot pump 28. Integrating Equation 1 reveals that the integration constant is set when steering system 20 is initially filled with hydraulic fluid.

Figure 5:
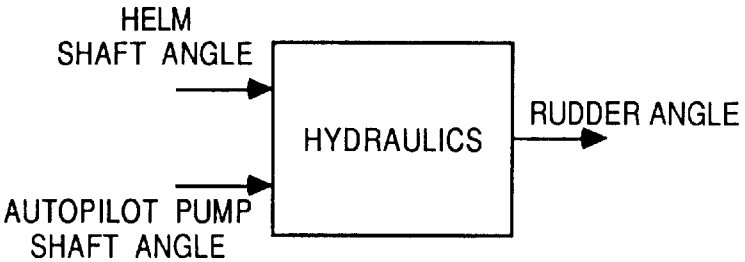
FIG. 5 (PRIOR ART)
FIG. 5 is a simplified block diagram representing the control interrelationships of the hydraulically actuated rudder system of FIG. 2.

FIG. 5 models the implications for the hydraulic steering devices of FIG. 2. The following example demonstrates a need for coordination of the operation between the helm and the autopilot. Assume that the helm and autopilot shaft angles are both initially at zero degrees. First rotate the autopilot pump shaft until the rudder angle is 10 degrees.

Then return the rudder angle to zero degrees by rotating the helm shaft. Under these conditions the rudder angle is at its zero degree starting point, but the helm and autopilot shaft angles are both different from their zero degree starting points. This means that helm 22 does not have a fixed "rudder centered" position. The advantage of this arrangement is that transferring control between the helm and the autopilot is very simple; just stop using one and start using the other. Unfortunately, it is a complex chore to provide interoperability of the helm and the autopilot. As described above in the background of the invention, rotating the helm while the autopilot is engaged simply causes the autopilot to subtract the helm input.

One approach to steering system simplification, and a step toward interoperability, is to augment a fly by wire steering system with a unified electronic steering controller. In this approach, the multiple power sources (the helm pumps and the autopilot pumps) are replaced by a single power source, and the helms are provided with transducers that convert rotational angles into electronic control signals.

Figure 6:
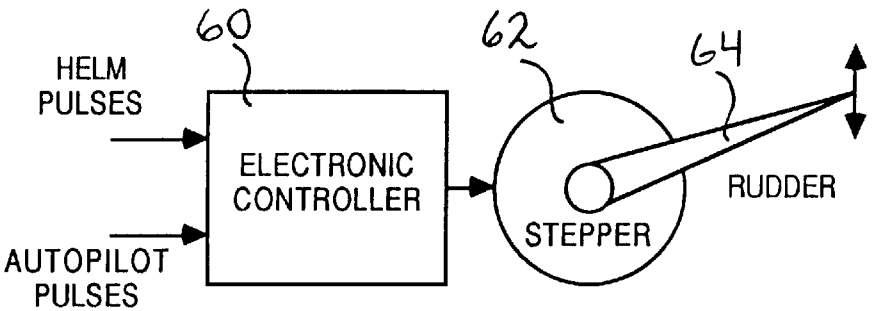
FIG. 6 is a simplified block diagram representing a stepper motor actuated implementation of the helm and autopilot rudder control system of FIGS. 2 and 5.

FIG. 6 represents an example of a such a system that is also analogous to the hydraulic system of FIGS. 2 and 5. An electronic controller 60 receives helm pulses from the helm transducer(s) and autopilot pulses from the autopilot. The pulses convey incremental rudder angle and direction commands. Incremental commands can be produced by a series of digital pulses, tachometric output pulses, or differentiated analog signal pulses that cause a static command source to provide a zero input to controller 60. Controller 60 sums the pulses and drives a stepper motor 62 to actuate a rudder 64. In this example system, the helm and autopilot pulses are analogous to the "q" terms of the pumps in Equation 1, and the sum is analogous to the integral of the "dr" term. This system is unconventional because steering controllers, such as electronic controller 60, are not ordinally employed for simultaneously processing multiple steering inputs to form a single rudder actuating output, and conventional autopilots provide rudder control outputs that are a function of a rudder angle error. No rudder angle error is employed in the FIG. 6 example system.

In practice, a more generalized and practical servomotor or electrohydraulic rudder actuator system presents somewhat different problems from those of the systems represented in FIGS. 2, 5, and 6. Such a practical rudder servo system would appear generally like the system represented in FIG. 3 in which the steering inputs are position rudder commands and the rudder servo system employs rudder angle transducer 52. If the rudder servo system is performing properly, the rudder is driven to the rudder angle commanded by the selected steering device.

Figure 3:
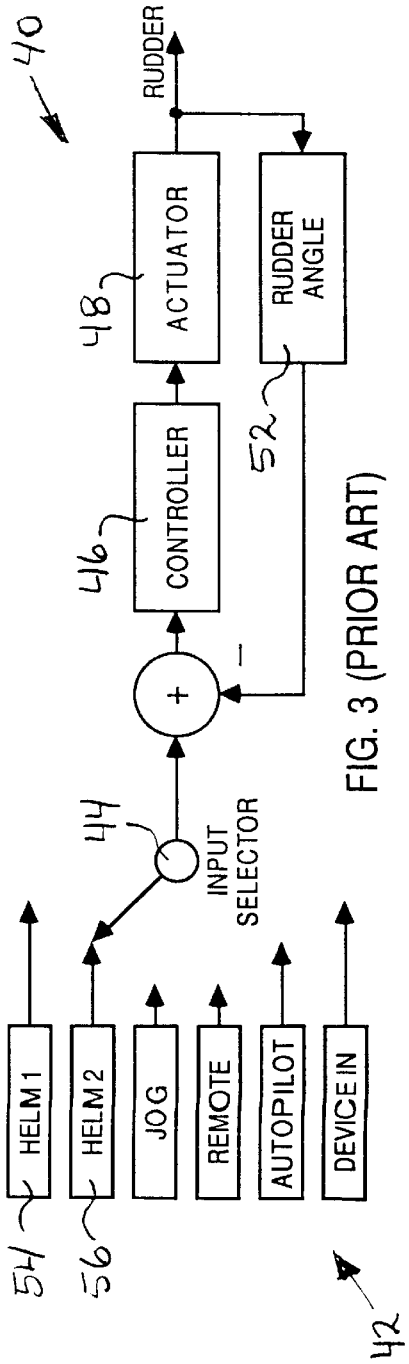
FIG. 3 (PRIOR ART)
FIG. 3 is a simplified control diagram representing a generalized prior art servomotor or electrohydraulic rudder actuator system having multiple control inputs.
Figure 4:
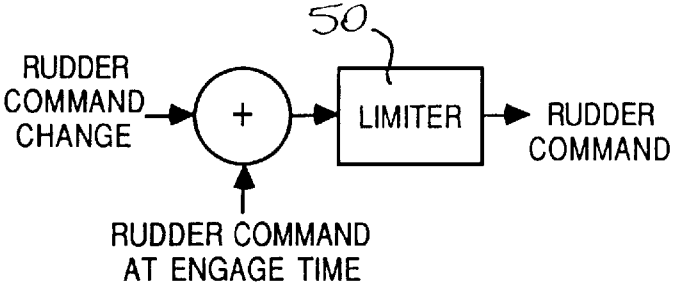
FIG. 4 (PRIOR ART)
FIG. 4 is a simplified control diagram representing a prior art steering command initialization technique employed in the control system of FIG. 3.
Figure 7:
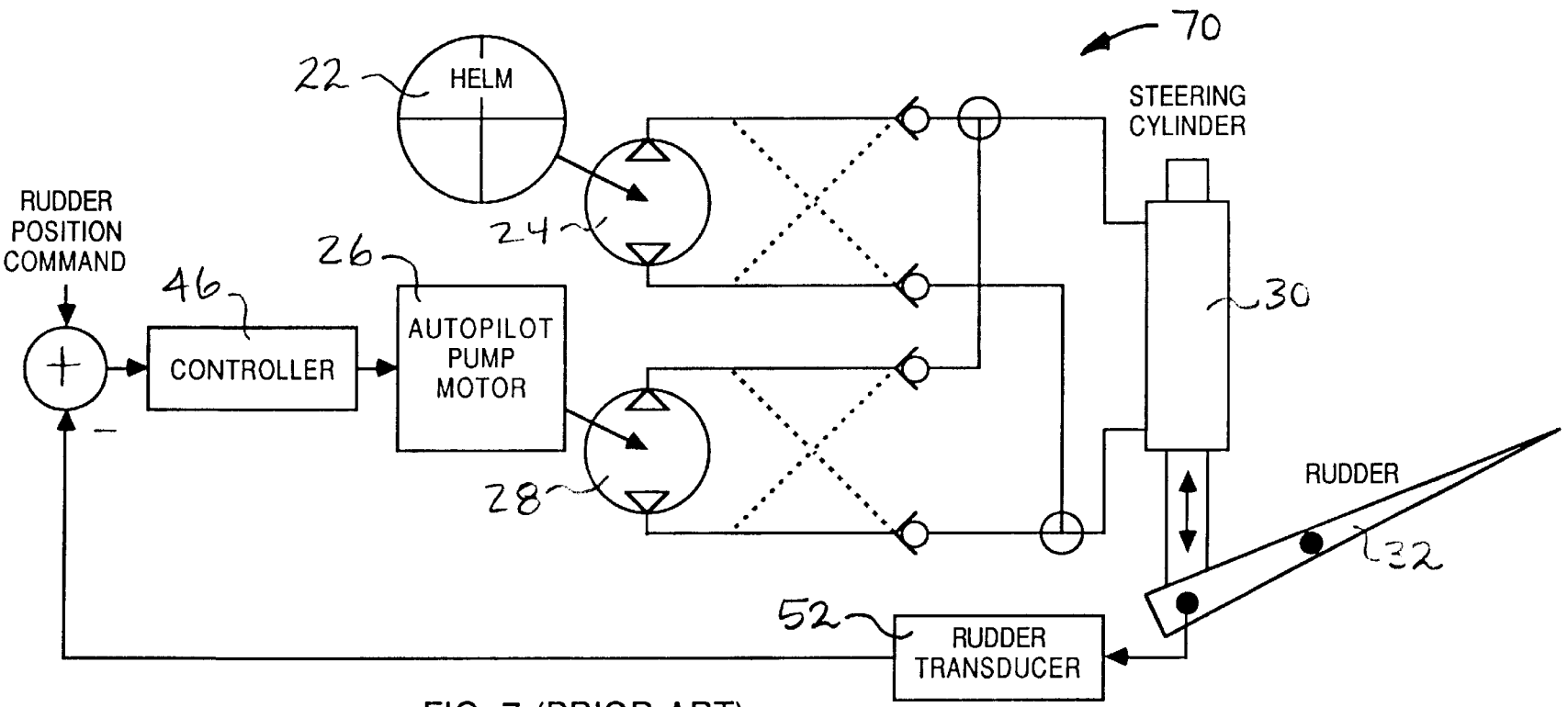
FIG. 7 (PRIOR ART)
FIG. 7 is a simplified block diagram representing the electronic control system of FIG. 3 combined with the hydraulic rudder actuator system of FIG. 2.

FIG. 7 represents such a system, which is actually a conventional autopilot steering system 70 that combines aspects of the hydraulic and fly by wire systems represented respectively in FIGS. 2 and 3. Steering system 70 can be viewed as an extension of a manual steering model in which, to turn the vessel at a desired rate, the helmsman turns helm 22 an amount proportional to the desired rate. Because the helmsman knows how far the helm was turned, the autopilot also needs to know how far it turned the helm. The difficulties associated with steering system 70 were set forth in the background of this invention with reference to FIGS. 2 and 3.

The overall steering problems stem from basic servo-based rudder controllers that cause the output to follow the input. Such servo-based systems create the unduly complex steering command initialization requirements of the prior art.

Figure 8:
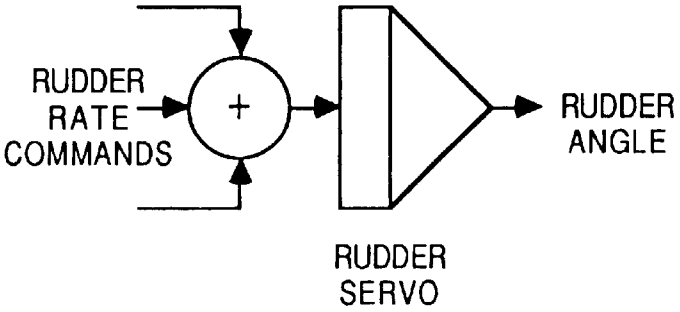
FIG. 8 is a simplified control diagram representing a multiple input servo rudder actuator.

FIG. 8 represents a rearrangement of the servo control blocks that leads to a solution of the problems. This rearrangement has the attributes of the hydraulic system represented by FIG. 2 with respect to transient free activation of any of the various inputs. Moreover, the rudder rate commands are equivalent to the "q" terms of Equation 1. A characteristic of the rudder rate command inputs is that they result from a process having no integrators that can continue to accumulate when the rudder reaches its mechanical stops. The rearrangement can be implemented by controlling fluid flow into a hydraulic ram or by a speed controlled electric motor as, for example, shown in U.S. Patent Nos. 5,632,217 and 5,509,369, which are assigned to the assignee of this application. Of course, there are limitations to making such a rate servo behave properly.

Figure 9:
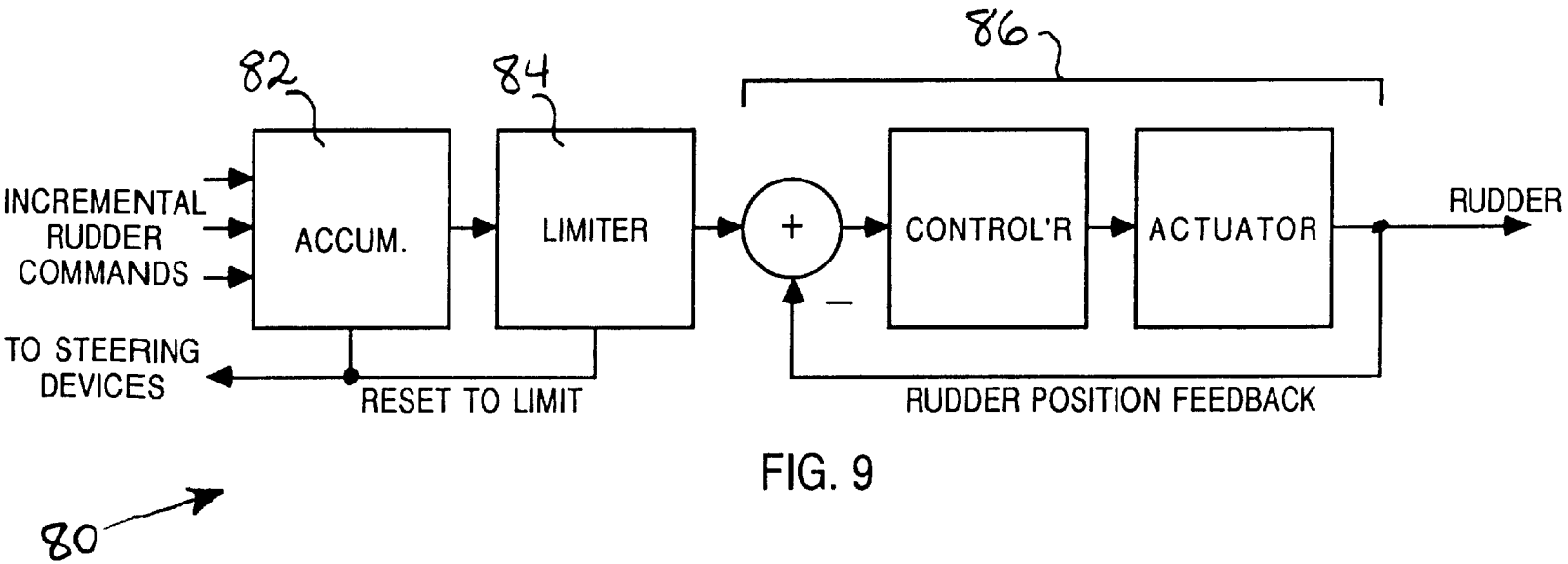
FIG. 9 is a simplified control diagram representing a more practical embodiment of the rudder actuator of FIG. 8.

FIG. 9 represents a more practical steering system 80, which is a specialization of the stepper system of FIG. 6 and in which the incremental rudder commands are analogous to the helm pulses. The incremental rudder commands are received by an accumulator 82, the output value of which is conveyed to a limiter 84 that resets accumulator 82 to the limit value whenever the output value exceeds the limit value. When the limiter is set to a value corresponding to the limit of rudder deflection, the reset on limit signal can be used to actuate helm stops and can be used to reset integrators in any of the command generating loops of the autopilot. Accumulator 82 further includes memory such that the output value equals the output value plus the sum of the incremental steering commands the sampling instant.

Steering system 80 includes a rudder position servomechanism 86 that receives steering commands from limiter 84. Servomechanism 86 has steering rate limits that may be exceeded by the steering command inputs. Accordingly, accumulator 82 also limits the incremental rudder commands to prevent continued accumulation of the output value when servomechanism 86 has reached its maximum slew rate. Such continuing accumulation of values is often referred to as "the integral windup problem." In severely rate limited cases, the rate limited condition may be broadcast to the input devices so that they can reset their internal integrators. (In general, an autopilot can make use of the integration implicitly performed in the actuator structure for normal integral requirements for rudder trim functions, and as such will have no outer loop integration requirements.)

If any of the steering devices generates absolute rudder commands, they can be converted to incremental rudder commands by periodically subtracting the current absolute command from-a previous absolute command. Another way of converting absolute commands to incremental commands is by clearing the incremental encoder accumulator after each data transmission.

Inhibiting data from an incremental steering device is a simple matter of blocking data transmissions or transmitting zeros. Authority limits for the autopilot can be implemented in the servo by ignoring autopilot steering increments that violate the authority limit. Authority limits are a way of removing some of the danger from autopilot features. For example, if the autopilot has a rudder deflection limit that is scheduled as a function of reciprocal vessel speed then, in theory, autopilot failures calling for full rudder deflection at high speed are blocked by the servo and become only small but erroneous rudder deflections that are less likely to tip the occupants form the vessel.

As previously described with reference to FIGS. 2 and 5, employing proportional control autopilots in incremental steering systems is problematic because a zero incremental rudder command does not cause the rudder to return to its centered position. This is caused by the incremental mechanization of the steering servo, which destroys the constant of integration implicit in a proportional controller, e.g., zero error yields zero deflection. However, this is an inconsequential condition because an autopilot without an integral channel in its controller will not trim the rudder. Moreover, because the servo acts like an integrator, an integral plus proportional autopilot is straightforward to implement. Equation 2 represents a control law for incremental plus proportional heading control using the incremental servo.

$$\text{Incremental rudder command}=(K_P+Tau*K_I)E-K_P*E_{PAST}, \quad (2)$$

where $K_P$=proportional gain, $K_I$=integral gain,

Tau=the sampling period,

E=heading error=heading command minus the current heading, and $E_{PAST}$=the E value at the update Tau seconds in the past.

An advantage of this servo/autopilot embodiment is that it completely avoids the integral windup problem found in conventional integral plus proportional autopilot steering systems.

Such steering systems employing incremental electric helms and an incremental servo provide a platform for new steering system features that include:

1) variable steering ratios in which the number or helm rotations required for stop to stop rudder deflection is variable;
2) interlinked helm and autopilot with automatic engagement and disengagement;
3) augmented steering, such as providing a heading or a turn rate control through the autopilot with the helm as the autopilot command device; and
4) electrically actuated helm rotation stops at the rudder limits to provide rudder "feedback" to the helmsman.

Employing variable steering ratios solves an annoying characteristic of conventional vessel steering systems. For example, when a vessel is moving at high speeds, small rudder angles cause large turning rates and corresponding high lateral accelerations. Therefore, to limit high-speed steering sensitivity, a typical steering ratio of three to five helm rotations stop to stop is typical. However, when docking or maneuvering the vessel at slow speeds, large rudder deflections are required to actually turn the vessel against winds. It is common that three or four full stop to stop rudder deflections are required to dock a vessel in windy conditions. This translates to 20 helm rotations. Clearly, a steering ratio that is a function of vessel speed is desirable.

Figure 10:
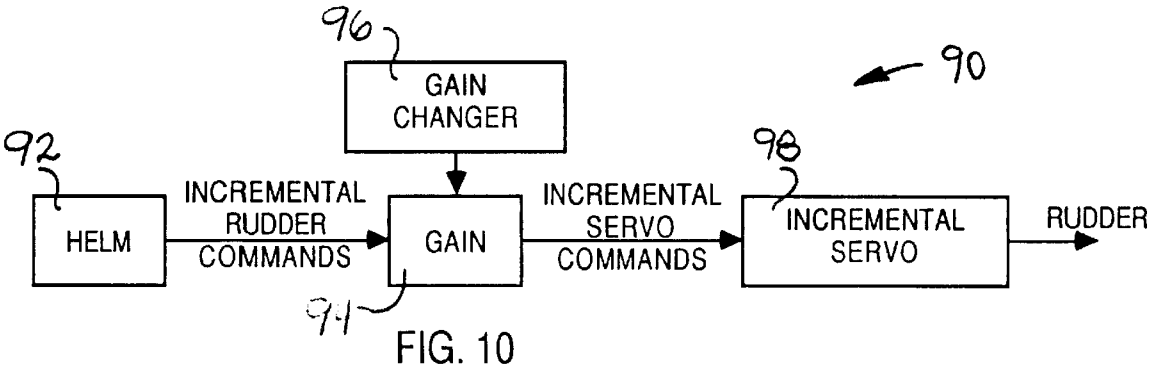
FIG. 10 is a simplified block diagram representing a variable ratio steering rate controller.

Because the coupling between the helm and rudder is electronic, variable steering ratios may be implemented electronically. FIG. 10 represents a preferred variable ratio steering controller 90 in which an incremental helm 92, or other incremental steering device, transmits incremental rudder commands to a gain block 94 that receives gain control information from a gain changer 96. Gain block 94 provides incremental servo commands to an incremental servo 98 for actuating the rudder. The incremental rudder commands are processed by a gain function in gain block 94 to provide the incremental servo commands.

The function of gain block 94 in the generation of controller 90 is described by the following example. Assume the rudder deflects ±45 degrees stop to stop and the helm provides one increment per degree of rotation. If the gain provided by gain block 94 is one-sixteenth (0.0625), then 1440 degrees (four turns) of helm rotation are required to deflect the rudder 90 degrees stop to stop. However, if the gain provided by gain block 94 is increased to one (1), then only 90 degrees (¼ turn) of helm rotation is required to deflect the rudder 90 degrees stop to stop.

The example given above is for two fixed gain functions. However, the gain function is preferably implemented as a set of gain tables that are selected by gain changer 96. Gain changer 96 may be implemented in many ways including: a gain knob; a computer menu; a graphical selection, such as in a "graphic" sound equalizer; and a switch including positions for docking and cruising. The gain may also be automatically scheduled as a function of vessel speed and/or engine revolutions per minute. A preferred method is to provide a gain table that relates helm angle to changes in yaw rate or lateral acceleration of the vessel.

An approximation of the steady state turning rate and lateral acceleration of a vessel in response to rudder deflection is represented below by Equations 3 and 4.

$$\frac{\Delta_{YAWRATE}}{\Delta_{RUDDER|SS}} \approx KU \quad (3)$$

$$\frac{\Delta_{LATERAL\ ACCEL}}{\Delta_{RUDDER|SS}} \approx KU^2, \text{ where} \quad (4)$$

U is the forward vessel speed. Therefore, for gain block 94 to produce incremental servo commands that turn the vessel at a constant rate to helm deflection ratio, gain changer 96 changes the gain as a function of 1/U, and for gain block 94 to produce incremental servo commands that turn the vessel at a constant lateral acceleration to helm deflection ratio, gain changer 96 changes the gain as a function of $1/U^2$.

Figure 11:
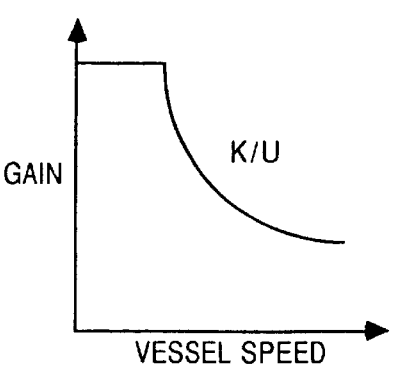
FIG. 11 is a graph representing preferred steering system gain or steering ratio as a function of vessel speed.

In a preferred embodiment, as the vessel speed decreases below a predetermined speed, the gain is limited to a predetermined value. FIG. 11 graphically represents a preferred gain table function that implements a constant turning rate as a function of vessel speed and a constant steering ratio (gain) below a predetermined vessel speed.

Figure 12:
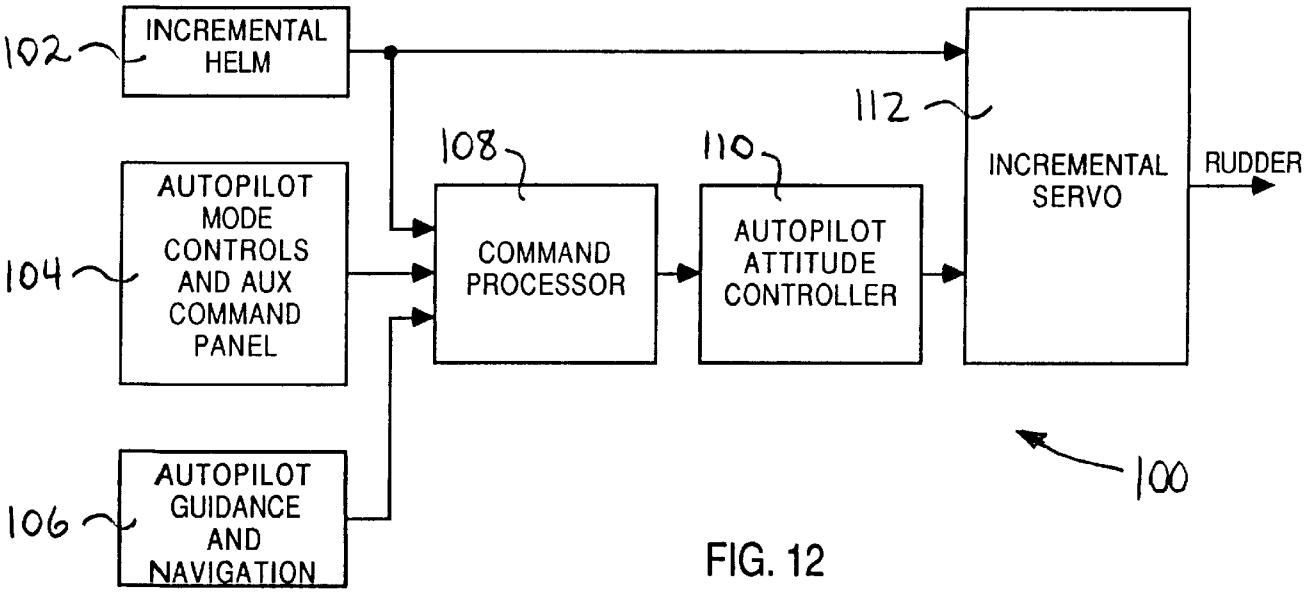
FIG. 12 is a simplified block diagram representing an interlinked helm and autopilot rudder control system of this invention.

Because the steering devices and autopilot are electronic, interlinking them may also be implemented electronically. FIG. 12 represents a steering system 100 of this invention that includes an incremental helm 102, a control panel 104, and an autopilot 106 all electrically connected to a command processor 108. Steering system 100 further includes an autopilot attitude controller 110 and an incremental servo 112 for actuating the rudder. Incremental helm 102 is electrically coupled to the incremental servo both directly and through command processor 108 and autopilot attitude controller 110.

There are many control and interlinking possibilities for steering system 100. In one embodiment, autopilot 106 may be engaged or disengaged by pressing buttons on control panel 104 or alternately disengaged by rotating incremental helm 102 a small amount. Course changes may be set in autopilot 106 by employing a course selection dial or specialized command buttons on control panel 104.

Figure 13:
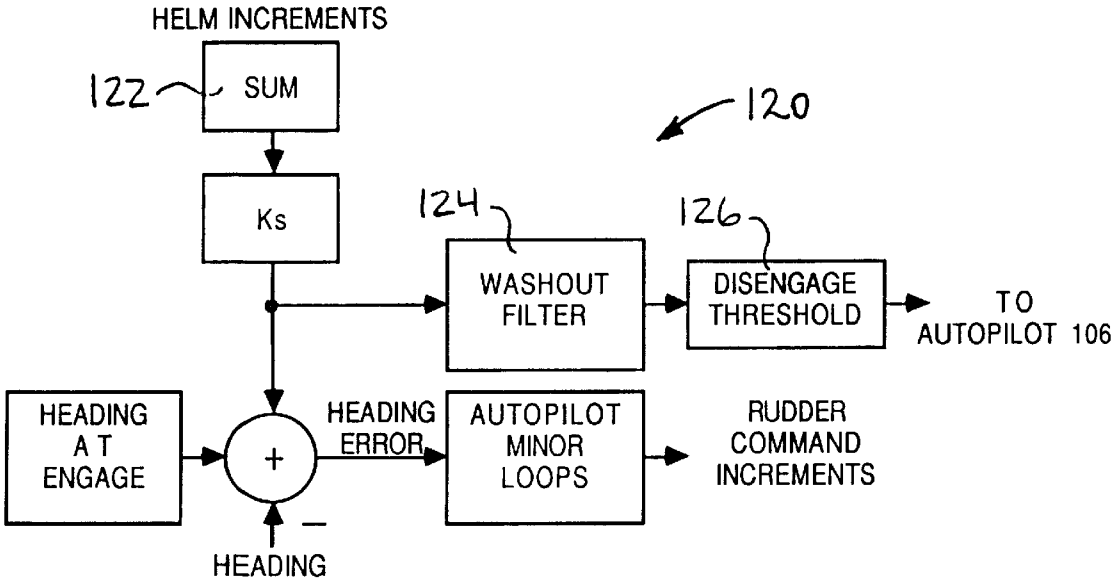
FIG. 13 is a simplified control diagram representing a helm actuated autopilot course selection controller of this invention.

However, in a preferred embodiment, incremental helm 102 is employed as a course selector for autopilot 106. FIG. 13 represents a course selection controller 120 of this invention that is implemented within command processor 108 and autopilot attitude controller 110. Upon engagement of autopilot 106, the heading set therein is the current heading at the instant of engagement plus any change of heading received from the helm after engagement. Course selection controller 120 employs a helm increment summer 122 and a washout filter 124 that are both initialized to zero upon engagement. A gain factor Ks is set to a desired steering ratio, e.g., one degree of heading change per degree of helm rotation. The output of washout filter 124 follows short-term course changes but forgets them over a longer time. A disengage threshold block 126 receives the output of washout filter 126 and causes autopilot 106 to disengage if the output exceeds a predetermined threshold. Accordingly, course selection controller 120 allows a helmsman to make occasional course changes without autopilot 106 automatically disengaging, but if the helmsman rotates the helm at a rate that causes washout filter 124 to exceed the predetermined threshold, autopilot 106 disengages. A preferred transfer function for washout filter 124 is represented by Equation 5:

$$TF = \frac{S}{S + \frac{1}{T\omega 0}}, \tag{5}$$

where Tω0 is the washout filter time constant.

The predetermined threshold can be adjusted as a function of vessel speed such that the greater the speed, the less wheel rotation is required to disengage autopilot 106. Upon automatic disengagement, autopilot 106 is inhibited from automatic engagement for a short time period by holding the disengagement signal true for a few seconds. After the short time period expires, autopilot 106 can automatically engage when the turning yaw rate approaches zero.

Figure 1:
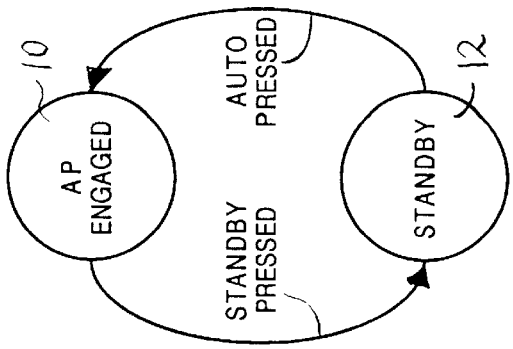
FIG. 1 (PRIOR ART)
FIG. 1 is a state diagram representing prior art autopilot engaging and disengaging operations.
Figure 14:
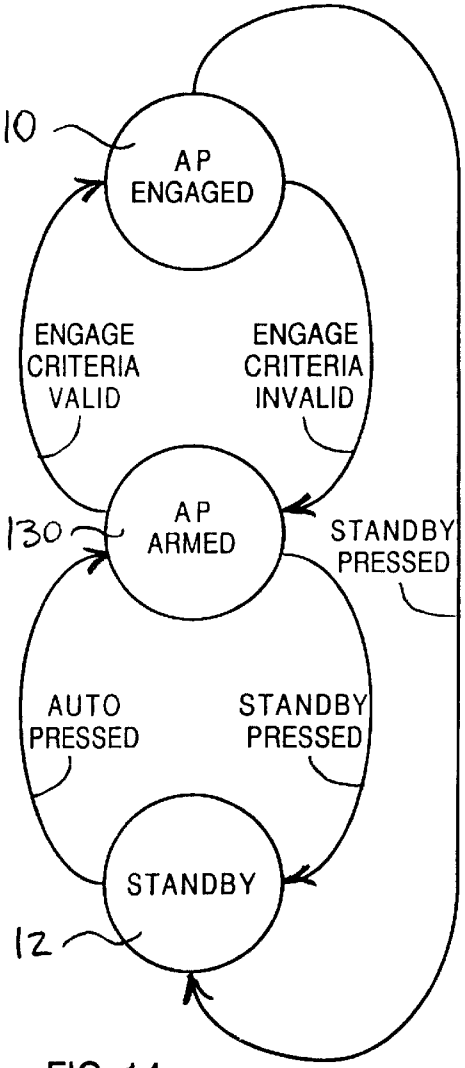
FIG. 14 is a state/diagram representing autopilot engaging, arming, and disengaging operations of this invention.

The differences between conventional autopilot engagement/disengagement techniques and the engagement/disengagement techniques of this invention are best understood by comparing FIGS. 1 and 14.

FIG. 1 shows that prior art autopilot states include engaged state 10 and standby state 12. These states are usually indicated on a control panel, and in engaged state 10 the autopilot controls the rudder, whereas in standby state 12 the autopilot does not control the rudder.

In contrast, FIG. 14 shows that steering system 100 of this invention not only includes autopilot engaged state 10 and standby state 12, but also an armed state 130. In this invention, pressing an AUTO button on control panel 104 (FIG. 12) causes autopilot 106 to transition from standby state 12 to armed state 130, which is an intermediate state between engaged state 10 and standby state 12. When in armed state 130, autopilot 106 is authorized to transition to engaged state 10 if course selection controller 120 (FIG. 13) allows it to do so. When the transition to engaged state 10 occurs, autopilot 106 takes control of the rudder, but course selection controller 120 continues to monitor helm increments and may cause a transition back to armed state 130. The helmsman can force autopilot 106 back to standby state 12 by pressing a STBY button on control panel 104.

Two advantages of steering system 100, which are fly by wire steering devices and variable steering ratios, unfortunately render the helm without an absolute center of rotation relative to the rudder position. The helmsman of such a system would clearly benefit from some form of intuitive rudder position feedback. Accordingly, this invention includes electrically actuated helm rotation stops at the rudder limits to provide rudder "feedback" to the helmsman.

As indicated in FIG. 9, the sum of all incremental steering device commands is processed by accumulator 82, and its output value is conveyed to limiter 84. Limiter 84 prevents the commands received by rudder position servomechanism 86 from exceeding a predetermined limit, which corresponds to the maximum rudder deflection angles each side of center. The limit signal generated by limiter 84 is conveyed to incremental helm(s) 102 (FIG. 12) to electrically actuate the helm rotation stops.

Figure 15B:
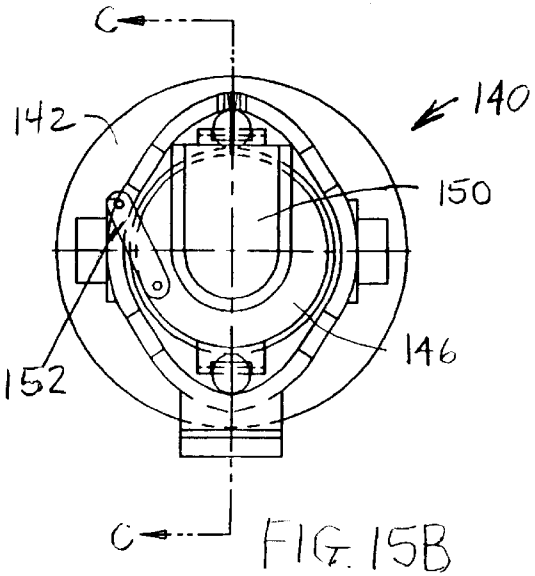
FIGS. 15A, 15B, and 15C show respective elevation, rear, and cross-sectional pictorial views of an incremental helm mechanism including an electrically actuated helm rotation stop of this invention.
Figure 15A:
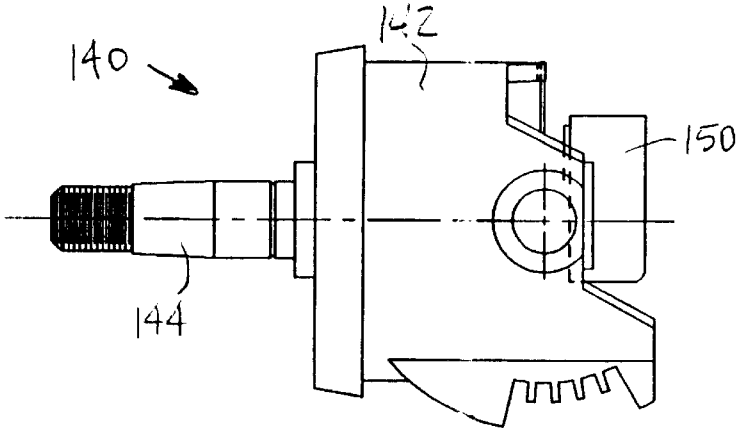
Figure 15C:
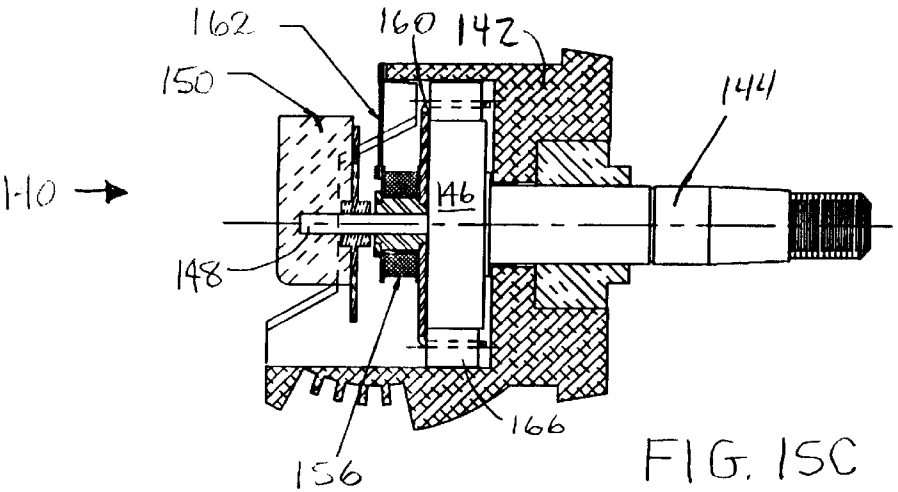

FIGS. 15A, 15B, and 15C show an incremental helm mechanism 140 that includes an electrically actuated helm rotation stop of this invention. Helm mechanism 140 includes a housing 142 that attaches to a bulkhead (not shown) and rotationally supports a steering shaft 144 to which a wheel (not shown) attaches at one end. The other end of steering shaft 144 supports a brake wheel 146 and a non-magnetic pin 148 for co-rotation by steering shaft 144.

An incremental encoder 150 is suspended by non-magnetic pin 148 and prevented from rotation by an anti-rotation link 152 that couples incremental encoder 150 to housing 142. A conventional encoder element (not shown) within incremental encoder 150 is rotated by non-magnetic pin 148 and generates helm rotation and direction information for steering system 100.

Figure 16:
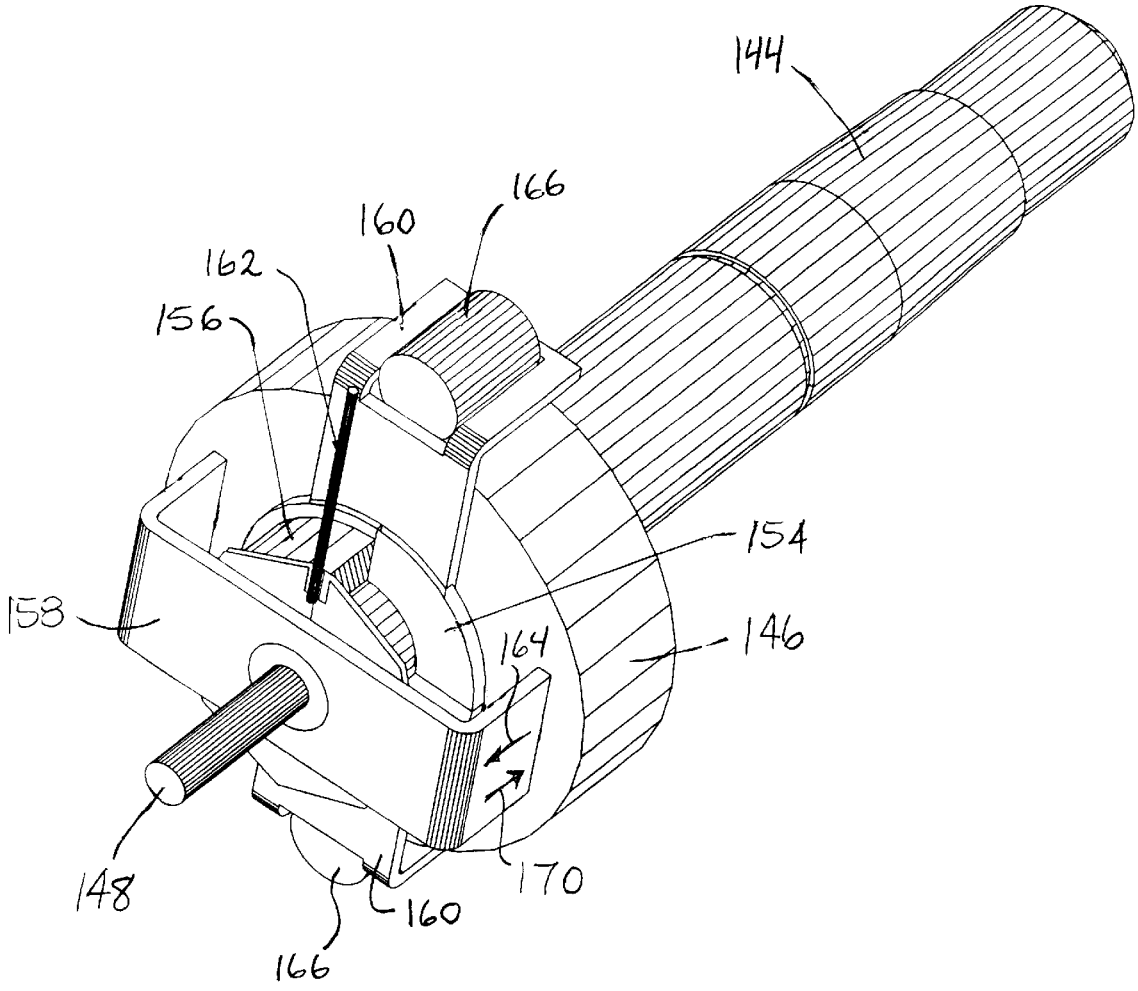
FIG. 16 is an isometric pictorial view revealing helm rotation stop components of the incremental helm mechanism of FIGS. 15A, 15B, and 15C.

Referring also to FIG. 16, the electrically actuated helm rotation stop includes components for stopping the rotation of brake wheel 146, which is coupled to steering shaft 144. A solenoid bobbin 154 including electromagnet windings 156 (shown in cross section), is mechanically coupled to a U-shaped brake shoe 158 and a roller cage 160. Solenoid bobbin 154, brake shoe 158, and roller cage 160 are freely movable or rotatable on non-magnetic pin 148. A centering spring 162 suspended from housing 142 urges helm rotation stop in a direction 164 that separates brake shoe 158 from brake wheel 146. Centering spring 162 also limits free rotation of the helm rotation stop about steering shaft 144 and urges roller cage 160 to assume a rotationally neutral position as shown in FIG. 17A. Roller cage 160 captivates a pair of lock rollers 166 that are free to rotate within roller cage 160.

FIG. 17A shows roller cage 160 and lock rollers 166 in the rotationally neutral position within housing 142. Housing 142 has an oval interior cross-sectional shape with long and short dimensions. The rotationally neutral position is aligned with the long dimension such that clearance gaps 168 exist in the nips formed among lock rollers 166, brake wheel 146, and housing 142. Clearance gaps 168 allow free rotation of lock rollers 166. Rotation of lock rollers 166 turns brake wheel 146 and steering shaft 144 to which it is coupled.

Referring again to FIG. 16, if the limit signal generated by limiter 84 (FIG. 9) is employed to energize windings 156, the helm rotation stop are drawn in a direction 170 that presses brake shoe 158 against brake wheel 146. This causes roller cage 160 to co-rotate with brake wheel 146 in response to any steering shaft 144 rotation. Accordingly, when steering shaft 144 is rotated while windings 156 are energized, roller cage 160 quickly assumes a rotationally offset position as shown in FIG. 17B.

Figure 17B:
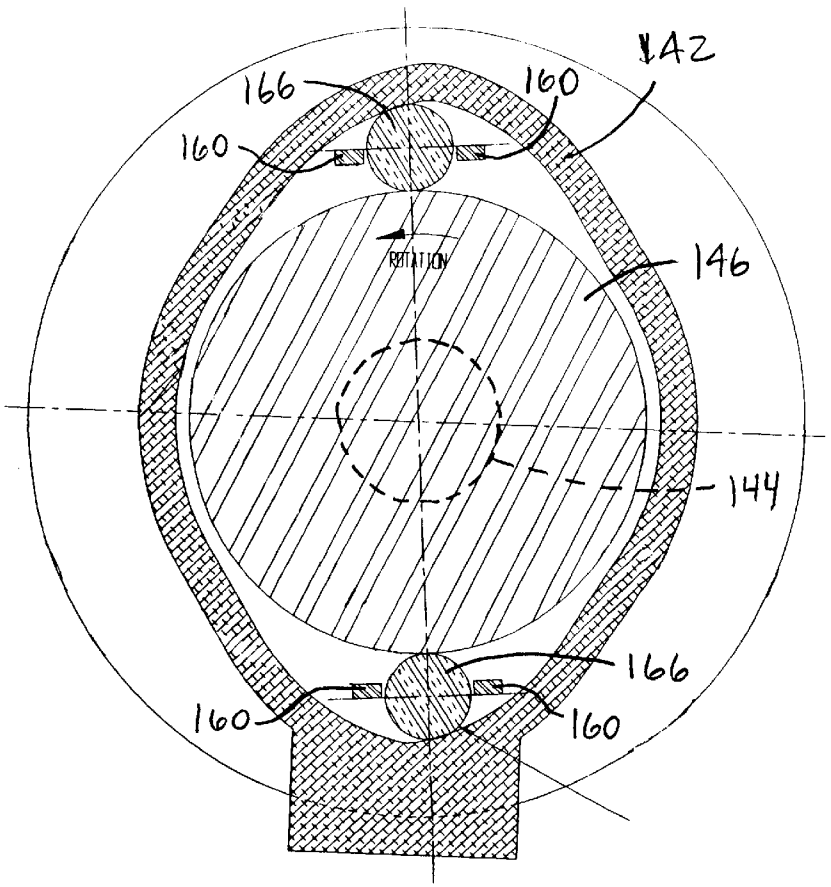
FIGS. 17A and 17B cross-sectional show end views of the helm rotation stop components of FIGS. 15 and 16 in respective helm free rotation and rotation stopping positions.
Figure 17A:
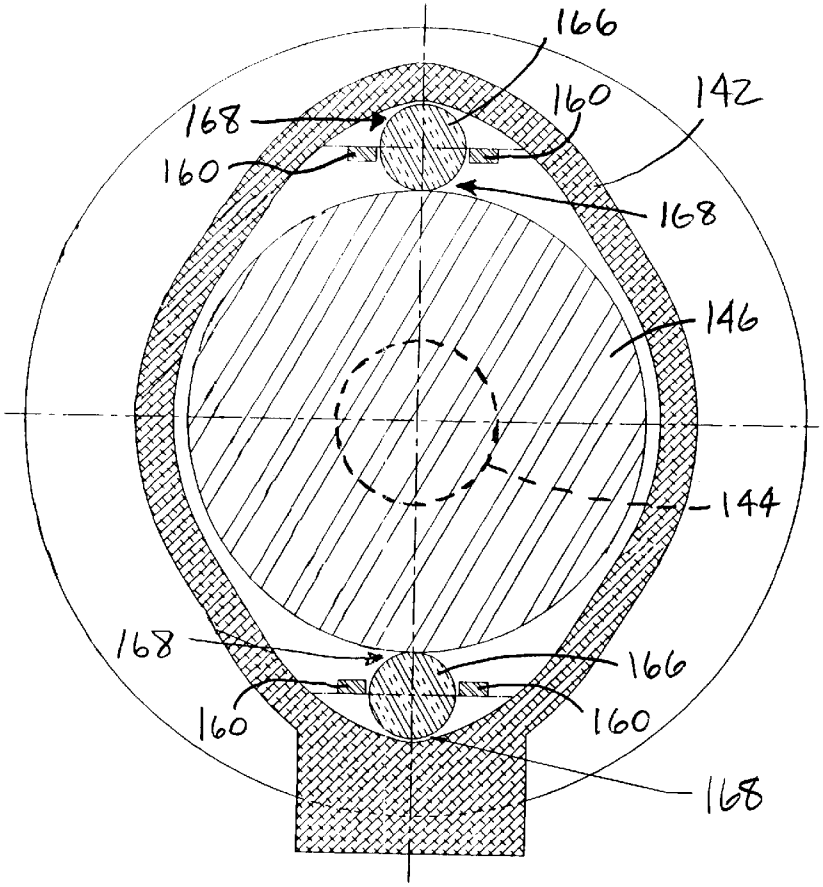

FIG. 17B shows roller cage 160 and lock rollers 166 in the rotationally offset position within housing 142. The rotationally offset position is rotationally biased toward the short dimension of housing 142 such that no clearance gaps exist in the nips formed among lock rollers 166 and brake wheel 146. The lack of clearance gaps causes lock rollers 166 to wedge between brake wheel 146 and housing 142, thereby preventing rotation of steering shaft 144. Moreover, attempted further rotation of steering shaft only increases the braking action of lock rollers 166.

If steering shaft 144 is rotated even a small amount in the opposite direction, however, limiter 84 (FIG. 9) deactivates the limit signal, which in turn deactivates windings 156 and causes the helm rotation stop to return to the rotationally neutral position of FIG. 17A, thereby allowing free rotation of steering shaft 144 until the opposite rotational limit is detected by limiter 84. FIG. 17B shows steering shaft 144 braking in the counter-clockwise rotational direction, but of course clockwise rotational braking takes place in a similar manner.

The helm rotation stop of this invention is many ways advantageous because it provides the helmsman with rudder stop position feedback, responds to the rudder stops regardless of the current steering ratio, incorporates wedging action that eliminates a need for a more powerful braking mechanism, and provides unidirectional braking at either rudder stop in response to a single limit signal.

Skilled workers will recognize that portions of this invention may be implemented differently from the implementations described above for preferred embodiments. For example, electrically activated multiple spring clutches or multiple one way roller clutches may be used to implement the helm rotation stop mechanism.

It will be obvious to those having skill in the art that many changes may be made to the details of the above-described embodiments of this invention without departing from the underlying principles thereof. Accordingly, it will be appreciated that this invention is also applicable to steering control applications other than those found in marine vessels. The scope of this invention should, therefore, be determined only by the following claims.

We claim:

1. A steering system for controlling a heading of a marine vessel, comprising:

a controllable turning moment generator operatively coupled to the marine vessel and controllable to follow a position command, the turning moment generator having mechanical limits;

multiple steering command sources at least one of which is a manual steering effector, each of the steering command sources providing incremental steering commands indicative of a command change in which a lack of the output signal is indicative of a constant steering command;

a steering command accumulator that accumulates a position command that is proportional to a sum of the incremental steering commands; and a limiter limiting the sum to a maximum value that represents the mechanical limits of the turning moment generator.

2. The steering system of claim 1 in which the multiple steering command sources include any combination of a heading entry control, a turn rate control, incremental helms, a jog control, a remote control, and an autopilot control.

3. The steering system of claim 1 further including an autopilot having armed and engaged states and providing incremental steering commands indicative of a steering command change, the autopilot switching between the armed and engaged states as a function of the manual steering effector incremental steering commands such that when in the armed state the autopilot generates no incremental steering commands and when in the engaged state provides a predominant steering command to the steering command accumulator.

4. The steering system of claim 3 in which the incremental steering commands include a steering rate component, and the steering system further comprising a course selection controller receiving the incremental steering commands and producing a signal that is a function of the incremental steering commands such that, if the steering rate component is less than a predetermined amount, the signal enables the autopilot to remain in the engaged state and to change the course setting in response to the incremental steering commands.

5. The steering system of claim 4 in which the signal causes the autopilot to enter the armed state in response to the steering rate component exceeding the predetermined amount, the armed state causing the incremental servo to control the heading in response to the incremental steering commands.

6. The steering system of claim 4 in which the signal is produced by a washout filter that follows changes in the incremental steering command for a first time period following the changes, but attenuates the changes over a second time period that is longer than the first time period.

7. The steering system of claim 1 further including a steering ratio controller that passes at least one of the incremental steering commands through a gain function to achieve a variable steering ratio.

8. The steering system of claim 7 in which the gain function includes a predetermined gain up to a predetermined vessel speed and a diminishing gain above the predetermined vessel speed.

9. The steering system of claim 7 in which the gain function includes at least one of a gain that is a reciprocal of the vessel speed, a gain that is proportional to the reciprocal of the vessel speed squared, a gain that is selectable by a switch or knob setting, a gain that is a function of revolutions per minute of a vessel propulsion system, and a gain that is determined from gain values stored in a gain table.

10. The steering system of claim 1 in which the limiter generates a limit signal indicative of the sum being at the maximum value, and in which at least one of the steering command sources includes a mechanically rotatable incremental helm having a helm rotation stop that is electrically actuated by the limit signal indicative of the turning moment generator being commanded to about a first mechanical limit.

11. The steering system of claim 10 in which the helm rotation stop inhibits mechanically rotating the helm in a first direction that commands the turning moment generator beyond about the first mechanical limit, but allows mechanically rotating the helm in a second direction that commands the turning moment generator toward a second mechanical limit.

12. The steering system of claim 10 in which the helm rotation stop includes a wedging action that increases a rotation stopping action as a function of a rotational force applied to the helm.

13. The steering system of claim 1, further comprising a command processor operatively associated with an autopilot control, the command processor receiving the incremental steering commands to produce vessel heading commands to which the autopilot control responds to operate the turning moment generator.

14. The steering system of claim 13, further comprising auxiliary heading command devices that provide steering signals to the command processor to modify the vessel heading commands to which the autopilot control responds.

15. A steering system for controlling a heading of a marine vessel, comprising:

a controllable turning moment generator operatively coupled to the marine vessel;

a steering command source providing incremental steering commands that result in the controllable turning moment generator imparting to the marine vessel a turning moment and a consequent rate of change of heading, the incremental steering commands further including a steering rate component;

an incremental servo responding to the incremental steering commands to provide to the controllable turning moment generator an actuating signal that causes the turning moment of the marine vessel;

an autopilot having standby, armed, and engaged states and providing incremental course commands for maintaining the heading in response to a course setting; and a course selection controller receiving the incremental steering commands and producing a signal that is a function of the incremental steering commands such that, if the steering rate component is less than a predetermined amount, the signal enables the autopilot to remain in the engaged state and to change the course setting in response to the incremental steering commands.

16. The steering system of claim 15 in which the signal causes the autopilot to enter the armed state in response to the steering rate component exceeding the predetermined amount, the armed state causing the incremental servo to control the heading in response to the incremental steering commands.

17. The steering system of claim 15 in which the signal is produced by a washout filter that follows changes in the incremental steering command for a first time period following the changes, but attenuates the changes over a second time period that is longer than the first time period.

18. A steering system for controlling a heading of a marine vessel, comprising:

a controllable turning moment generator operatively coupled to the marine vessel;

a steering command source providing incremental steering commands that result in the controllable turning moment generator imparting to the marine vessel a turning moment and a consequent rate of change of heading;

an incremental servo responding to the incremental steering commands to provide to the controllable turning moment generator an actuating signal that causes the turning moment of the marine vessel; and a steering ratio controller that passes the incremental steering commands through a gain function that includes a predetermined gain up to a predetermined vessel speed and a diminishing gain above the predetermined vessel speed to achieve a variable steering ratio.

19. A steering system for controlling a heading of a marine vessel, comprising:

a controllable turning moment generator operatively coupled to the marine vessel;

a steering command source providing incremental steering commands that result in the controllable turning moment generator imparting to the marine vessel a turning moment and a consequent rate of change of heading;

an accumulator and a limiter, the accumulator receiving the incremental steering commands to produce an accumulated steering command, and the limiter generating a limit signal that resets the accumulator to a predetermined limit whenever the accumulated steering command attempts to exceed the predetermined limit; and an incremental servo responding to the accumulated incremental steering commands to provide to the controllable turning moment generator an actuating signal that causes the turning moment of the marine vessel.

20. A steering system for controlling a heading of a marine vessel, comprising:

a controllable turning moment generator operatively coupled to the marine vessel;

a steering command source providing incremental steering commands that result in the controllable turning moment generator imparting to the marine vessel a turning moment and a consequent rate of change of heading, the steering command source further including a mechanically rotatable incremental helm having a helm rotation stop that is electrically actuated by a limit signal indicative of the turning moment generator being commanded to about a first mechanical limit; and an incremental servo responding to the incremental steering commands to provide to the controllable turning moment generator an actuating signal that causes the turning moment of the marine vessel.

21. The steering system of claim 20 in which the helm rotation stop inhibits mechanically rotating the helm in a first direction that commands the turning moment generator beyond about the first mechanical limit, but allows mechanically rotating the helm in a second direction that commands the turning moment generator toward a second mechanical limit.

22. The steering system of claim 20 in which the helm rotation stop includes a wedging action that increases a rotation stopping action as a function of a rotational force applied to the helm.

23. A steering system for controlling a heading of a marine vessel, comprising:

a controllable turning moment generator operatively coupled to the marine vessel;

a steering command source providing incremental steering commands that result in the controllable turning moment generator imparting to the marine vessel a turning moment and a consequent rate of change of heading;

an incremental servo responding to the incremental steering commands to provide to the controllable turning moment generator an actuating signal that causes the turning moment of the marine vessel; and a command processor operatively associated with an autopilot control, the command processor receiving the incremental steering commands to produce vessel heading commands to which the autopilot control responds to cause the servo to operate the turning moment generator.

24. The steering system of claim 23, further comprising auxiliary heading command devices that provide steering signals to the command processor to modify the vessel heading commands to which the autopilot control responds.

* * * * *

UNITED STATES PATENT AND TRADEMARK OFFICE

CERTIFICATE OF CORRECTION

PATENT NO. : 6,311,634 B1 
DATED : November 6, 2001
INVENTOR(S) : Douglas W. Ford, Eric K. Juve and Douglas F. Paterson It is certified that error appears in the above-identified patent and that said Letters Patent is hereby corrected as shown below:

Column 1,
Line 34, “input.” should be -- input --.

Column 4,
Line 21, “state/diagram” should be -- state diagram --.

Column 6,
Line 29, “commands the” should be -- commands at the --.
Line 48, “from-a” should be -- from a --.
Line 63, “form” should be -- from --.

Column 7,
Line 28, “or” should be -- of --.

Signed and Sealed this

Eleventh Day of February, 2003

JAMES E. ROGAN
*Director of the United States Patent and Trademark Office*